US008218992B2

(12) United States Patent
Park

(10) Patent No.: US 8,218,992 B2
(45) Date of Patent: Jul. 10, 2012

(54) METHOD AND APPARATUS TO CONTROL COOLING FAN TO COOL FUSING UNIT OF IMAGE FORMING APPARATUS

(75) Inventor: Soo-cheol Park, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 220 days.

(21) Appl. No.: 12/267,715

(22) Filed: Nov. 10, 2008

(65) Prior Publication Data

US 2009/0238598 A1 Sep. 24, 2009

(30) Foreign Application Priority Data

Mar. 21, 2008 (KR) ..... 10-2008-0026296

(51) Int. Cl.
*G03G 15/20* (2006.01)

(52) U.S. Cl. ..... 399/69; 399/44; 399/70; 399/92

(58) Field of Classification Search ..... 399/38, 399/44, 69–70, 91–93
See application file for complete search history.

(56) References Cited

U.S. PATENT DOCUMENTS

| | | | | |
|---|---|---|---|---|
| 5,138,375 | A * | 8/1992 | Iimori | 399/92 |
| 6,253,042 | B1 * | 6/2001 | Yang | 399/92 |
| 2003/0219274 | A1 * | 11/2003 | Hirose et al. | 399/92 |
| 2006/0088326 | A1 * | 4/2006 | Nakayama | 399/69 |
| 2006/0127119 | A1 * | 6/2006 | Sato | 399/69 |
| 2006/0291894 | A1 * | 12/2006 | Chung et al. | 399/92 |

* cited by examiner

*Primary Examiner* — David Porta
*Assistant Examiner* — Casey Bryant
(74) *Attorney, Agent, or Firm* — Stanzione & Kim, LLP

(57) ABSTRACT

To control a cooling fan to cool a fusing unit of an image forming apparatus, it is determined whether the fusing unit is turned on or off. If the fusing unit is determined to be turned on or off, it is determined whether a condition to turn the cooling fan on or off is satisfied. If the cooling fan on/off condition is satisfied, the cooling fan is turned on or off. Thus, the driving of the cooling fan is minimized when the driving of the cooling fan is unnecessary so that the cooling fan is driven at a high efficiency.

13 Claims, 6 Drawing Sheets

METHOD AND APPARATUS TO CONTROL COOLING FAN TO COOL FUSING UNIT OF IMAGE FORMING APPARATUS

CROSS-REFERENCE TO RELATED APPLICATIONS

This application claims the benefit of Korean Patent Application No. 10-2008-0026296, filed on Mar. 21, 2008, in the Korean Intellectual Property Office, the disclosure of which is incorporated herein in its entirety by reference.

BACKGROUND OF THE INVENTION

1. Field of the Invention

The present general inventive concept relates to a method and apparatus to control a cooling fan to cool a fusing unit of an image forming apparatus, and more particularly, to a method and apparatus to efficiently control a cooling fan to cool a fusing unit of an image forming apparatus in which an image is formed by heating and pressing toner using a heat source of the fusing unit.

2. Description of the Related Art

In an image forming apparatus, an image is formed by heating and pressing toner using a heat source of a fusing unit, and high temperature heat is used for improving the fixation of the toner. The fusing unit that generates high temperature heat for the fixation of the toner is cooled using a cooling fan, and the high temperature heat generated from the fusing unit is dissipated to the outside of the image forming apparatus, so as to prevent possible damage to other parts in the image forming apparatus. Thus, a method of efficiently controlling a cooling fan to prevent possible damage to other parts in the image forming apparatus and reduce noise generated due to the driving of the cooling fan is needed.

FIG. 1 is a timing diagram illustrating a conventional method of controlling a cooling fan to cool a fusing unit of an image forming apparatus. Referring to FIG. 1, in the conventional method of controlling a cooling fan for cooling a fusing unit of an image forming apparatus, the cooling fan is controlled such that the cooling fan is driven at a time point A when heat is supplied to the fusing unit and stopped at a time point B when the supply of heat to the fusing unit is discontinued. That is, according to the conventional method, the driving of the cooling fan is controlled such that the time point for driving the cooling fan is synchronized with the time point for supplying heat to the fusing unit.

However, the temperature of the fusing unit does not reach a high temperature as soon as heat is supplied to the fusing unit and does not instantly return to room temperature as soon as the supply of heat to the fusing unit is discontinued. Thus, in the conventional method, the cooling fan is driven when unnecessary and so is not efficiently driven. Additionally, unnecessary noise is generated and energy is wasted. Therefore, to address this problem, a method of efficiently controlling the driving of the cooling fan according to the actual temperature of the fusing unit is needed.

SUMMARY OF THE INVENTION

The present general inventive concept provides a method of efficiently driving a cooling fan by determining whether a fusing unit is turned on or off, determining whether a condition to turn the cooling fan on or off is satisfied when the fusing unit is determined to be turned on or off, and turning the cooling fan on or off when the condition to turn the cooling fan on or off is satisfied.

The present general inventive concept also provides a computer readable recording medium having recorded thereon a program for executing the method.

Additional aspects and utilities of the present general inventive concept will be set forth in part in the description which follows and, in part, will be obvious from the description, or may be learned by practice of the general inventive concept.

The foregoing and/or other aspects of and utilities of the present general inventive concept may be achieved by providing a method of controlling a cooling fan to cool a fusing unit of an image forming apparatus, the method providing determining whether the fusing unit is turned on or off, if the fusing unit is turned on or off determining whether a condition to turn the cooling on or off is satisfied, and if the cooling fan on/off condition is satisfied turning the cooling fan on or off.

The cooling fan on/off condition may be at least one of, after the fusing unit is turned on or off, a preset delay time passes, and the fusing unit reaches a preset temperature.

The condition that the fusing unit reaches a preset temperature may be at least one of: the fusing unit reaches a first temperature after the fusing unit is turned on, and the fusing unit reaches a second temperature after the fusing unit is turned off.

The preset delay time is changeable as desired, for example, depending on the requirements of the fusing unit.

The turning of the cooling fan on or off may include gradually increasing the rotation speed of the cooling fan after the cooling fan is turned on or gradually decreasing the rotation speed of the cooling fan after the cooling fan is turned on.

The method may further include indicating that the cooling fan is turned on/off, after the fusing unit is turned on or off.

The foregoing and/or other aspects of and utilities of the present general inventive concept may also be achieved by providing a method of controlling a cooling fan for cooling a fusing unit of an image forming apparatus which may include determining whether the fusing unit is turned on or off according to the state of the image forming apparatus, if the fusing unit is turned on or off determining whether at least one condition is satisfied where, after the fusing unit is turned on or off, a preset delay time passes and the fusing unit reaches a preset temperature, and if the condition is satisfied, turning the cooling fan on or off.

The condition that the fusing unit reaches a preset temperature may be at least one of the conditions that the fusing unit reaches a first temperature after the fusing unit is turned on, and the fusing unit reaches a second temperature after the fusing unit is turned off.

The state of the image forming apparatus is any one of a power-on state, a warm-up state, a stand-by state, a printing state, a power-save state, and a power-off state.

The present general inventive concept also may provide a computer readable recording medium having recorded a program for executing any of the above methods.

The foregoing and/or other aspects of and utilities of the present general inventive concept may also be achieved by providing an apparatus to control a cooling fan to cool a fusing unit of an image forming apparatus which may include a control time point determination unit determining whether the cooling fan on/off condition is satisfied after the fusing unit is turned on or off, and a cooling fan control unit to turn the cooling fan on or off if the cooling fan on/off condition is satisfied.

The foregoing and/or other aspects of and utilities of the present general inventive concept may also be achieved by providing an apparatus to control an image forming apparatus, which may include a fusing unit, a cooling fan, and a controller to control the cooling fan according to a time period after the turning on or turning off of the fusing unit. The time period may be determined based on the time required for the fusing unit to reach a predetermined temperature.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION OF THE PREFERRED EMBODIMENTS

Figure 1:
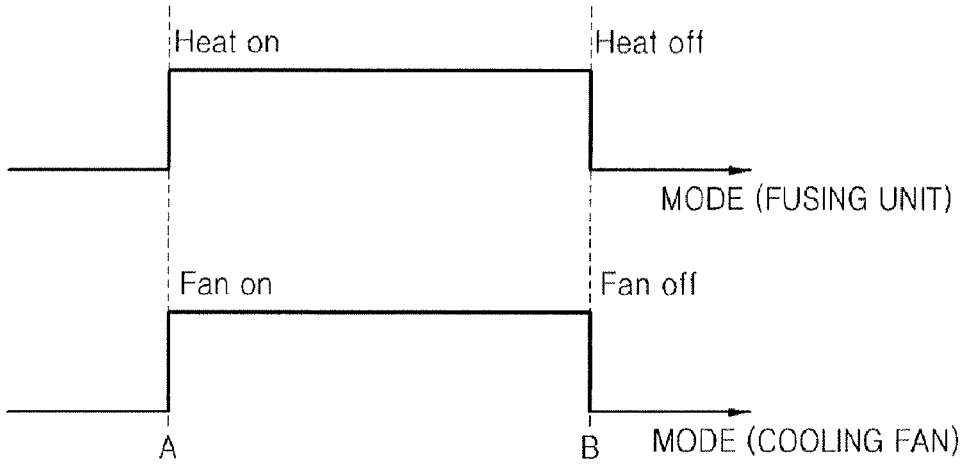
FIG. 1 (PRIOR ART)
FIG. 1 is a timing diagram illustrating a conventional method of controlling a cooling fan to cool a fusing unit of an image forming apparatus.

The accompanying drawings illustrating exemplary embodiments of the present general inventive concept are referred to in order to gain a sufficient understanding of the present general inventive concept, the merits thereof, and the objectives accomplished by the implementation of the present general inventive concept. Hereinafter, the present general inventive concept will be described in detail by explaining exemplary embodiments of the invention with reference to the accompanying drawings. Like reference numerals in the drawings refer to like elements throughout.

Figure 2A:
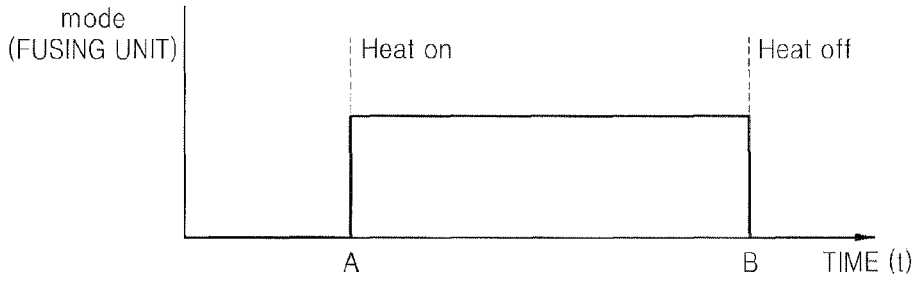
FIG. 2A is a timing diagram illustrating start and stop time points of the heating of a fusing unit, according to an embodiment of the present general inventive concept.
Figure 2B:
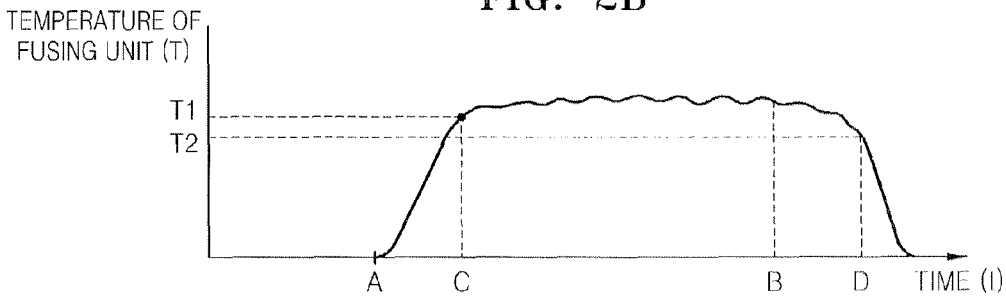
FIG. 2B is a timing diagram illustrating the temperature of the fusing unit according to the supply of heat and the discontinuation of the supply of heat, according to an embodiment of the present general inventive concept.

FIG. 2A is a timing diagram illustrating time points when the heating a fusing unit (not shown) starts and stops, according to an embodiment of the present general inventive concept. FIG. 2B is a timing diagram showing the temperature of the fusing unit according to the supply of heat and the discontinuation of the supply of heat to the fusing unit, according to an embodiment of the present general inventive concept. Referring to FIG. 2A, time point A denotes when heat is supplied to begin heating the fusing unit, while time point B denotes when the supply of heat to the fusing unit is discontinued so that the heating of the fusing unit stops. Referring to FIG. 2B, the temperature of the fusing unit starts to rise from time point A and reaches a first temperature T1 at time point C. The temperature of the fusing unit starts to fall from time point B and reaches a second temperature T2 at time point D.

Figure 2C:
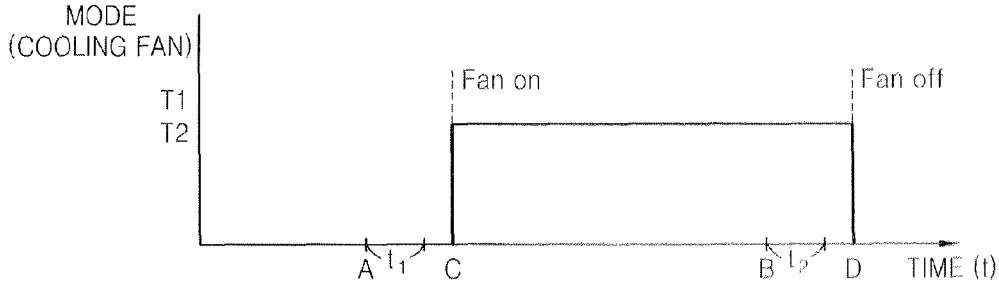
FIG. 2C is a timing diagram illustrating start and stop time points of the driving of the cooling fan in a method of controlling a cooling fan to cool a fusing unit of an image forming apparatus, according to an embodiment of the present general inventive concept.

FIG. 2C is a timing diagram illustrating start and stop time points of driving of the cooling fan in a method of controlling a cooling fan to cool a fusing unit of an image forming apparatus, according to an embodiment of the present general inventive concept. The cooling fan is driven at time point C, not time point A when the heating of the fusing unit starts, and the driving of the cooling fan is stopped at time point D, not at time point B when the heating of the fusing unit is stopped.

In detail, the cooling fan is driven at time point C when the temperature of the fusing unit is the first temperature T1 after a first time $t_1$ passes after time point A. The cooling fan is stopped at time point D when the temperature of the fusing unit is the second temperature T2 after a second time $t_2$ passes after time point B. Also, the rotation speed of the cooling fan may be gradually increased after the cooling fan is driven or the cooling fan may be stopped by gradually decreasing the rotation speed of the cooling fan.

In an embodiment, the first temperature T1 used to determine the start driving time point is different from the second temperature T2 used to determine the stop driving time point. However, the present general inventive concept is not limited thereto and the first and second temperatures T1 and T2 may be the same. Also, the first time $t_1$ and the second time $t_2$ may be the same.

Figure 2D:
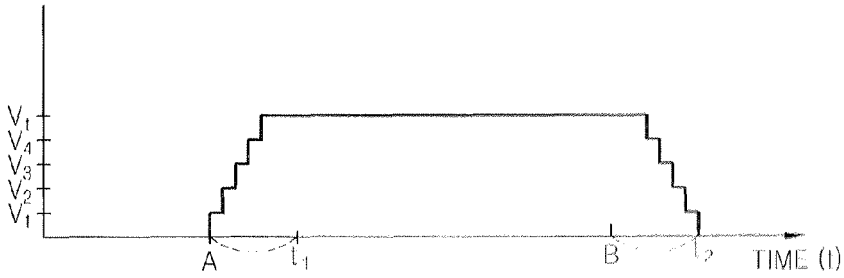
FIG. 2D is a timing diagram illustrating start and stop of the driving of the cooling fan in a method of controlling a cooling fan to cool a fusing unit of an image forming apparatus, according to another embodiment of the present general inventive concept.

FIG. 2D is a timing diagram illustrating start and stop time points of the driving of the cooling fan in a method of controlling a cooling fan to cool a fusing unit of an image forming apparatus, according to another embodiment of the present general inventive concept. Referring to FIG. 2D, at time point A both the heating of the fusing unit and the driving of the cooling fan are begun. The cooling fan is driven at a first speed V1 from time point A. The speed of the cooling fan is increased by a predetermined speed at each time point after passing a predetermined time from time point A. When the first time $t_1$ passes after time point A, the speed of the cooling fan is controlled such that the cooling fan is driven at a predetermined speed Vt. Also, from time point B when the heating of the fusing unit is stopped, the speed of the cooling fan is decreased by a predetermined speed at each time point after passing a predetermined time $t_2$ from time point B. When the second time $t_2$ passes after time point B, the speed of the cooling fan is controlled such that the cooling fan is stopped. The predetermined time, $t_1$ or $t_2$, may be obtained by equally dividing time $t_1$ or $t_2$, respectively, by a constant value, which may represent, for example, the number of steps between V1 and Vt.

Figure 3:
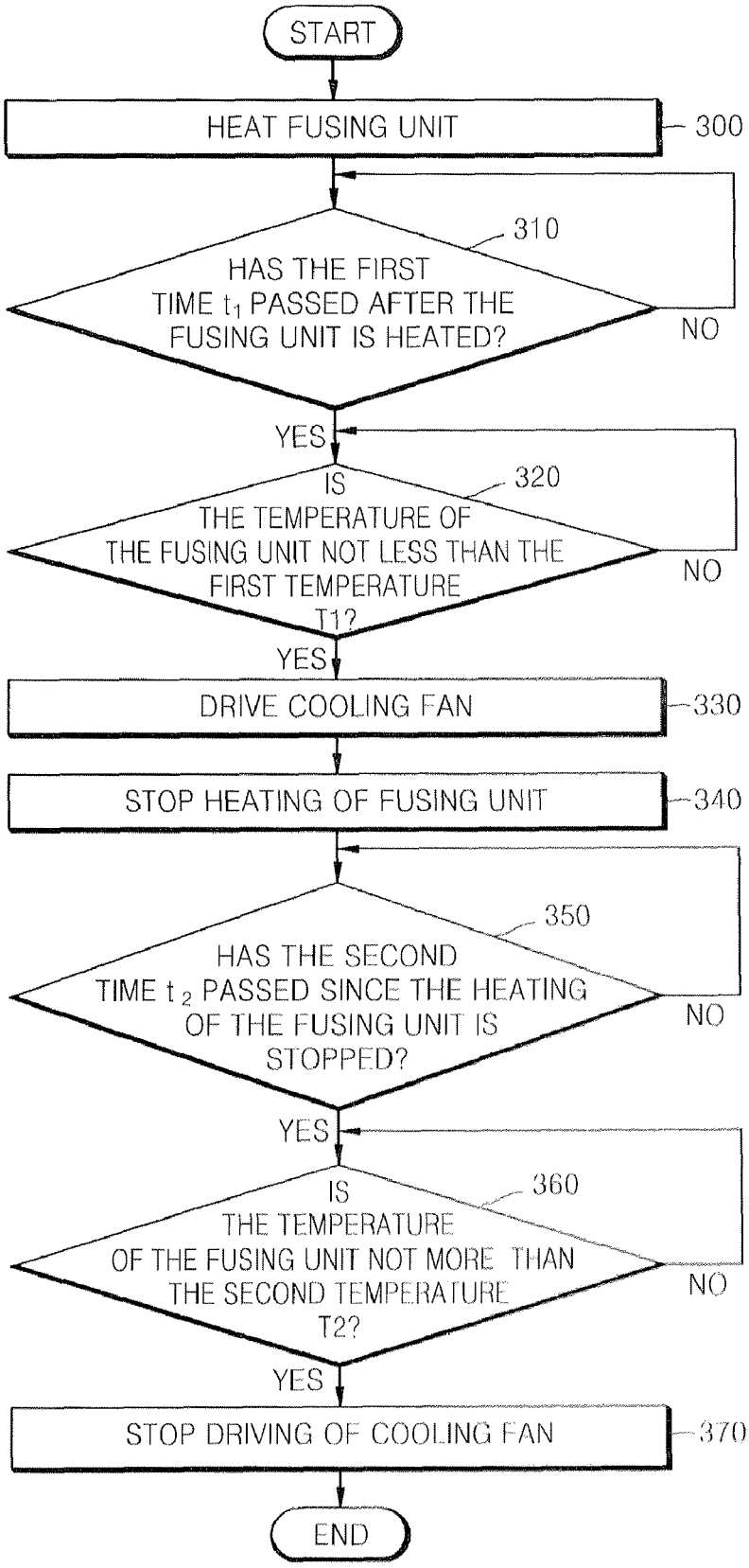
FIG. 3 is a flowchart illustrating a method of controlling a cooling fan to cool a fusing unit of an image forming apparatus, according to an embodiment of the present general inventive concept.

FIG. 3 is a flowchart illustrating a method of controlling a cooling fan to cool a fusing unit of an image forming apparatus, according to an embodiment of the present general inventive concept. Referring to FIGS. 2A to 2C, and 3, in the method of the present embodiment, in Operation 300, heat is supplied to the fusing unit to heat the fusing unit. In the present embodiment, a time point for supplying heat to the fusing unit is regarded as a time point for turning the fusing unit on and a time point for stopping the supply of heat to the fusing unit is regarded as a time point for turning the fusing unit off. Referring to FIG. 2A, heat is supplied to the fusing unit at time point A so as to heat the fusing unit.

In Operation 310, it is determined whether the first time $t_1$ has passed after the fusing unit is heated. The first time $t_1$ may be set based on information about the time required for the temperature of the fusing unit to reach a predetermined temperature when heat is supplied to the fusing unit. That is, the first time $t_1$ may be set at a value smaller than the time required for the temperature of the fusing unit to reach a predetermined temperature when heat is supplied to the fusing unit. Operation 310 is repeated from time point A when heating the fusing unit has begun until the first time $t_1$ has passed. If it is determined that the first time $t_1$ has passed from time point A, Operation 320 is performed. The first time $t_1$ and the second time $t_2$ may be changed as needed, for example, depending on the requirements of the fusing unit.

In Operation 320, it is determined whether the temperature of the fusing unit is not less than the first temperature T1. The first temperature T1 may vary, and may be set, for example, depending on the requirements of the fusing unit. If the temperature of the fusing unit is determined to be not less than the first temperature T1, Operation 330 is performed.

In Operation 330, the cooling fan is driven when the temperature of the fusing unit is the first temperature T1. Referring to FIG. 2C, the cooling fan is driven at the time point C when the temperature of the fusing unit is the first temperature T1.

In Operation 340, and referring to FIG. 2A, the supply of heat to the fusing unit is stopped at time point B.

In Operation 350, it is determined whether the second time $t_2$ has passed after the heating of the fusing unit is stopped. The second time $t_2$ may be set based on information about the time required for the temperature of the fusing unit to reach a predetermined temperature. Operation 350 may be repeated after the heating of the fusing unit is stopped until the second time $t_2$ has passed. If it is determined that the second time $t_2$ has passed after the heating of the fusing unit is stopped, Operation 360 is performed.

In Operation 360, it is determined whether the temperature of the fusing unit is not more than the second temperature T2. If the temperature of the fusing unit is determined to be not more than the second temperature T2, Operation 370 is performed.

In Operation 370, the driving of the cooling fan is stopped when the temperature of the fusing unit is the second temperature T2. Referring to FIG. 2C, the cooling fan is stopped at the time point D when the temperature of the fusing unit is the second temperature T2. Also, it may be indicated whether the cooling fan is turned on or off. Such indication may be, for example, a visual indication, such as a light on the image forming apparatus or an indication on a display. Such indication may also be, for example, an audible indication.

Figure 4:
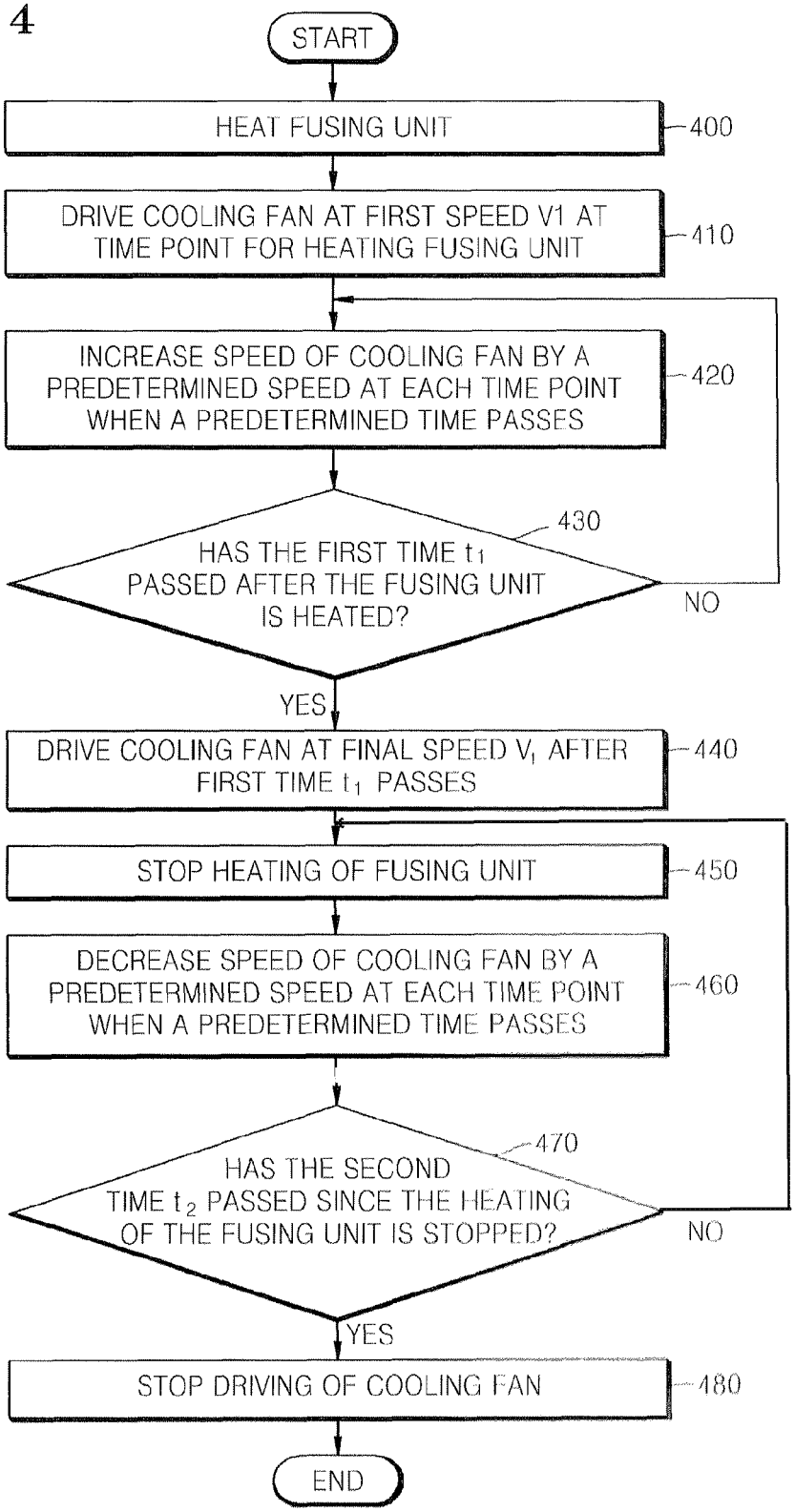
FIG. 4 is a flowchart illustrating a method of controlling a cooling fan to cool a fusing unit of an image forming apparatus, according to another embodiment of the present general inventive concept.

FIG. 4 is a flowchart illustrating a method of controlling a cooling fan to cool a fusing unit of an image forming apparatus, according to another embodiment of the present general inventive concept. Referring to FIGS. 2A, 2B, 2D, and 3, in Operation 400, heat is supplied to the fusing unit to heat the fusing unit. Referring to FIG. 2A, heat is supplied to the fusing unit at the time point A to heat the fusing unit.

In Operation 410, the cooling fan is driven at the first speed V1 at the time point A for heating the fusing unit. In Operation 420, after the cooling fan is driven at the first speed V1, the speed of the cooling fan is increased by a predetermined speed at each time point after a predetermined time passes. As shown in FIG. 2D, when the predetermined time passes, the cooling fan is driven at a second speed V2, increased by a predetermined speed from the first speed V1, the original driving speed. After another predetermined time passes, the cooling fan is driven at a third speed V3, increased by a predetermined speed from the second speed V2. The predetermined time may be obtained by equally dividing the first time $t_1$ by a constant value. The value of the predetermined speed increase may be obtained by equally dividing the final speed of the cooling fan Vt by a predetermined period of time.

In Operation 430, it is determined whether the first time $t_1$ has passed from the time point A for heating the fusing unit. If it is determined that the first time $t_1$ has passed after heat is applied to the fusing unit, Operation 440 is performed.

In Operation 440, the cooling fan is driven at the final speed Vt after the first time $t_1$ passes. The final speed Vt may be set as the maximum speed of the cooling fan. In Operation 450, the supply of heat to the fusing unit is stopped to stop the heating of the fusing unit.

In Operation 460, the speed of the cooling fan is decreased at each time point when a predetermined time passes after the heating of the fusing unit is stopped. As shown in FIG. 2D, the speed of the cooling fan is decreased from a preset final speed Vt to the first speed V1 by a predetermined speed at each time point when a predetermined time passes.

In Operation 470, it is determined whether the second time $t_2$ has passed after the heating of the fusing unit is stopped. If it is determined that the second time $t_2$ has passed after the heating of the fusing unit is stopped, Operation 480 is performed. In Operation 480, the cooling fan is stopped after the second time $t_2$ passes.

Figure 5:
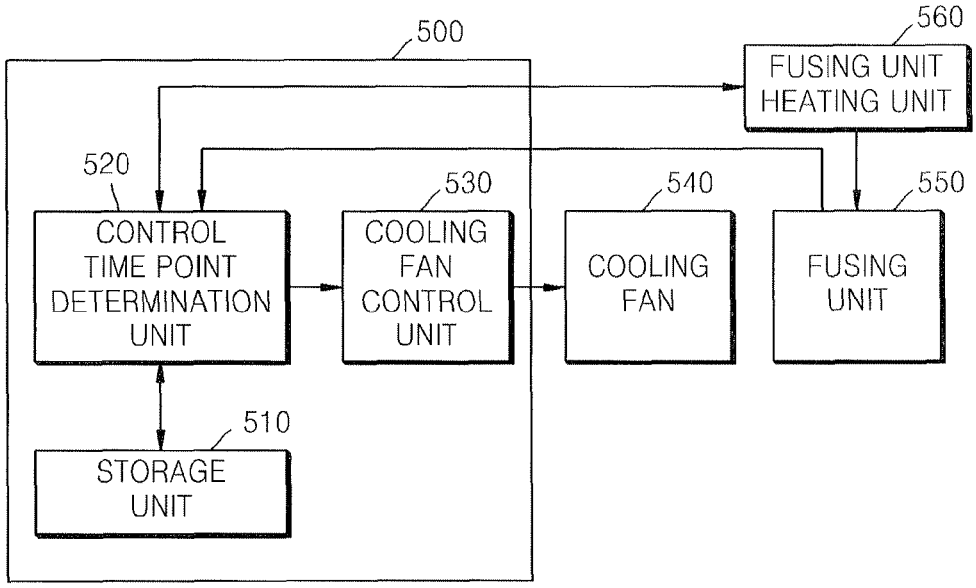
FIG. 5 is a block diagram illustrating the structure of an apparatus to control a cooling fan to cool a fusing unit of an image forming apparatus, according to an embodiment of the present general inventive concept.

FIG. 5 is a block diagram showing the structure of an apparatus 500 for controlling a cooling fan to cool a fusing unit of an image forming apparatus, according to an embodiment of the present general inventive concept. Referring to FIG. 5, the apparatus 500 of the present embodiment includes a storage unit 510, a control time point determination unit 520, and a cooling fan control unit 530.

In the operation of the apparatus 500 of the present embodiment as shown in FIG. 5, a fusing unit heating unit 560 supplies heat to a fusing unit 550 to heat the fusing unit 550 or stops the supply of heat to the fusing unit 550 to stop the heating of the fusing unit 550. When the fusing unit heating unit 560 supplies heat to the fusing unit 550 or stops the supply of heat to the fusing unit 550, the control time point determination unit 520 receives an input of information about the start time point for heating the fusing unit 550, or information about the stop time point for stopping the heating of the fusing unit 550, from the fusing unit heating unit 560. The control time point determination unit 520 measures the temperature of the fusing unit 550 and receives an input of information about the temperature of the fusing unit 550.

The storage unit 510 stores information from control time point determination unit 520 about the first time $t_1$, used for determining the driving control time point of a cooling fan 540, and information about the second time $t_2$, used for determining the stop driving control time point of the cooling fan 540. The control time point determination unit 520 can also receive the information about the first time $t_1$ and the information about the second time $t_2$ from the storage unit 510.

In the apparatus 500 of the present embodiment, the control time point determination unit 520 is described as receiving an input of the information about the first time $t_1$ and the information about the second time $t_2$, from the storage unit 510. However, the present general inventive concept is not limited thereto and the information about the first time $t_1$ and the information about the second time $t_2$ may be stored in the control time point determination unit 520.

The control time point determination unit 520 determines the time points for controlling the cooling fan 540 based on the information about the heating start time point and heating stop time point received from the fusing unit heating unit 560, the temperature of the fusing unit 550 as measured by the control time point determination unit 520, the information received from the storage unit 510 about the first time $t_1$ and the second time $t_2$, the information about the time passing after the heating of fusing unit 550 has begun, and the information about the time passing after the heating of the fusing unit 550 is stopped.

In detail, the control time point determination unit 520 determines when the temperature of the fusing unit 550, which is measured after the first time $t_1$ passes from the time point when heating the fusing unit 550 is begun and is received from the fusing unit heating unit 560, reaches the first temperature T1, as the driving control time point for starting the driving of the cooling fan 540. Also, the control time point determination unit 520 determines when the temperature of the fusing unit 550, which is measured after the second time $t_2$ passes from the time point when the heating of the fusing unit 550 is stopped and is received from the fusing unit heating unit 560, reaches the second temperature T2, as the stop driving control time point for stopping the driving of the cooling fan 540. The first temperature T1 and the second temperature T2 are temperatures preset by the control time point determination unit 520.

The cooling fan control unit 530 receives the input of the driving control time point from the control time point determination unit 520, and controls the cooling fan 540 to be driven or stopped at the received driving control time point. In detail, when receiving the driving control time point from the control time point determination unit 520, the cooling fan control unit 530 controls the cooling fan 540 to be driven at a constant speed at the received driving control time point. Also, when receiving the stop driving control time point from the control time point determination unit 520, the cooling fan control unit 530 controls the cooling fan 540 to stop at the received stop driving control time point.

Figure 6:
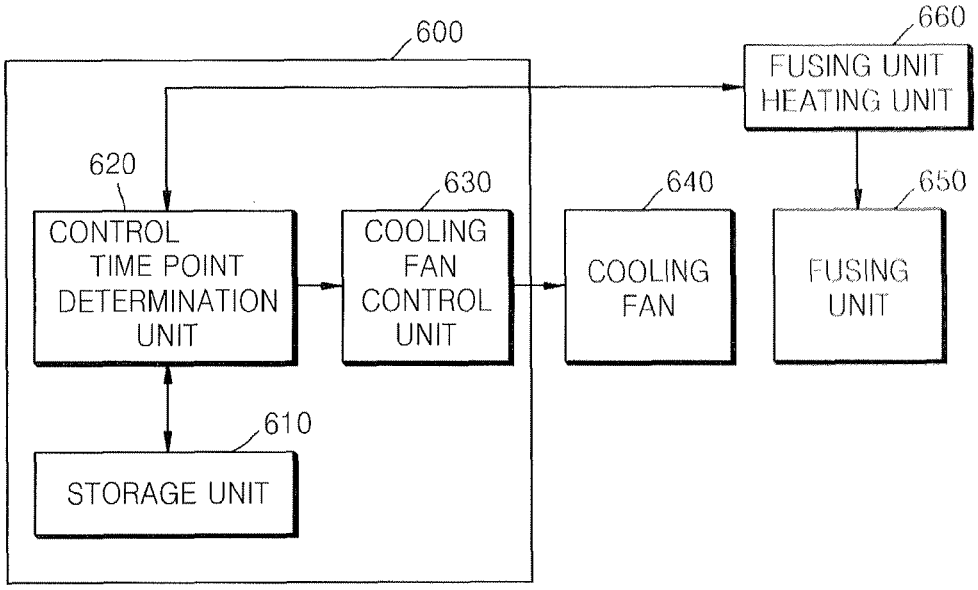
FIG. 6 is a block diagram illustrating the structure of an apparatus to control a cooling fan to cool a fusing unit of an image forming apparatus, according to another embodiment of the present general inventive concept.

FIG. 6 is a block diagram showing the structure of an apparatus 600 for controlling a cooling fan to cool a fusing unit of an image forming apparatus, according to another embodiment of the present general inventive concept. Referring to FIG. 6, the apparatus 600 of the present embodiment includes a storage unit 610, a control time point determination unit 620, and a cooling fan control unit 630.

In the operation of the apparatus 600 of the present embodiment as shown in FIG. 6, a fusing unit heating unit 660 supplies heat to a fusing unit 650 to heat the fusing unit 650 or stops the supply of heat to the fusing unit 650 to stop the heating of the fusing unit 650. When the fusing unit heating unit 660 supplies heat to the fusing unit 650 or stops the supply of heat to the to the fusing unit 650, the control time point determination unit 620 receives an input of information about the time point for heating the fusing unit 650 or information about the time point for stopping the heating of the fusing unit 650, from the fusing unit heating unit 660.

The storage unit 610 stores information from the control start time point determination unit 620 about the first time $t_1$, used for determining the start driving control time point of the cooling fan 640, information about the second time $t_2$, used for determining the stop driving control time point of the cooling fan 640, and the final speed Vt of the cooling fan 640. The control time point determination unit 620 receives an input of the information about the first time $t_1$ and the information about the second time $t_2$ from the storage unit 610.

In the apparatus 600 of the present embodiment, the control time point determination unit 620 is described as receiving an input of the information about the first time $t_1$, the information about the second time $t_2$, and the final speed Vt of the cooling fan 640, from the storage unit 610. However, the present general inventive concept is not limited thereto and the information about the first time $t_1$, the information about the second time $t_2$, and the final speed Vt of the cooling fan 640 may be stored in the control time point determination unit 620.

The control time point determination unit 620 determines the start driving control time point for starting the control of the cooling fan 640 based on the information about the heating time point and heating stop time point received from the fusing unit heating unit 660.

In detail, the control time point determination unit 620 determines the heating time point received from the fusing unit heating unit 660 as the start driving control time point for starting the drive of the cooling fan 640, and the heating stop time point received from the fusing unit heating unit 660 as the stop driving control time point for stopping the drive of the cooling fan 640.

The cooling fan control unit 630 receives the input of the start driving control time point from the control time point determination unit 620 and controls the cooling fan 640 to be driven or stopped at the received time point. In detail, when cooling fan control unit 630 receives the start driving control time point from the control time point determination unit 620, cooling fan control unit 630 controls the cooling fan 640 to be driven at the first speed V1 at the received start driving control time point. The cooling fan control unit 630 controls the cooling fan 640 to be driven at an increased speed by increasing the speed of the cooling fan 640 by a predetermined speed at each time point when a predetermined time passes from the start driving control time point. The cooling fan control unit 630 controls the cooling fan 640 to be driven at the final speed after the first time $t_1$ passes from the start driving control time point by increasing the speed of the cooling fan 640 such that the speed of the cooling fan 640 reaches preset final speed Vt when the first time $t_1$ passes from the start driving control time point.

When receiving the stop driving control time point from the control time point determination unit 620, the cooling fan control unit 630 controls the cooling fan 640 to be driven at a decreased speed by decreasing the speed of the cooling fan 640 by a predetermined speed at each time point when a predetermined time passes from the received stop driving control time point. The cooling fan control unit 630 controls the cooling fan 640 to be stopped when the second time $t_2$ passes from the stop driving start time point.

Figure 7:
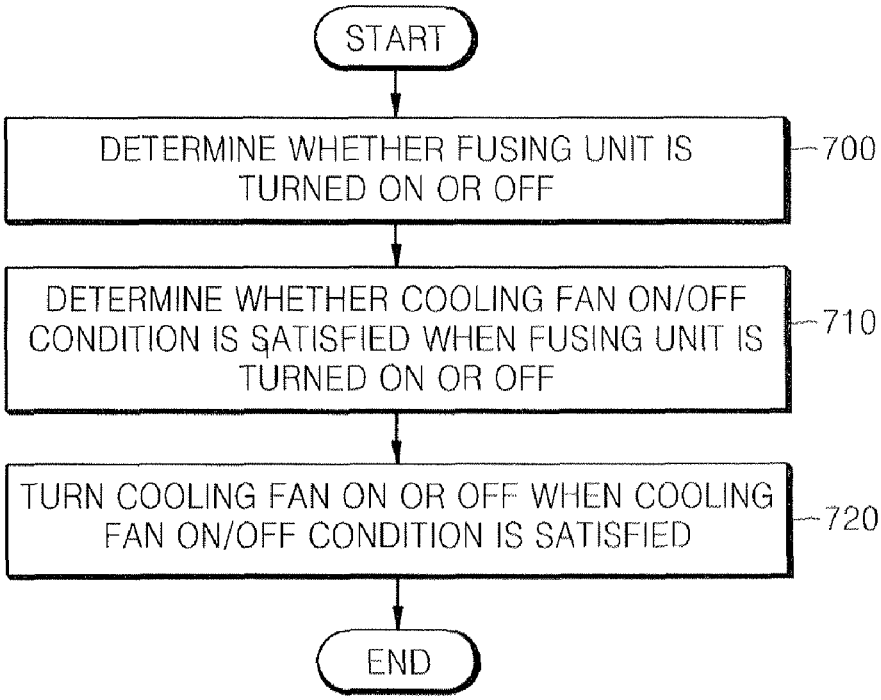
FIG. 7 is a flowchart illustrating a method of controlling a cooling fan to cool a fusing unit of an image forming apparatus, according to another embodiment of the present general inventive concept.

FIG. 7 is a flowchart illustrating a method of controlling a cooling fan to cool a fusing unit of an image forming apparatus, according to another embodiment of the present general inventive concept. In Operation 700, it is determined whether the fusing unit is turned on or off based on the state of the image forming apparatus. The state of the image forming apparatus may be one of a power-on state, a warm-up state, a stand-by state, a printing state, a power-save state, and a power-off state.

In Operation 710, when the fusing unit is turned on or off, it is determined whether a condition to turn the cooling fan on or off is satisfied. The cooling fan on/off condition is at least one of the conditions that, after the fusing unit is turned on or off, a preset delay time passes, and the fusing unit reaches a preset temperature. Also, the condition that the fusing unit reaches a preset temperature is at least one of the conditions that the fusing unit reaches a first temperature after the fusing unit is turned on, and the fusing unit reaches a second temperature after the fusing unit is turned off. The preset delay time may be changed as required, for example, depending on the requirements of the fusing unit.

In Operation 720, when the cooling fan on/off condition is satisfied, the cooling fan is turned on or off. As described above, the rotation speed of the cooling fan may be gradually increased after the cooling fan is turned on, or the cooling fan may be stopped by gradually decreasing the rotation speed of the cooling fan. Also, it may be indicated whether the cooling fan is turned on or off.

Figure 8:
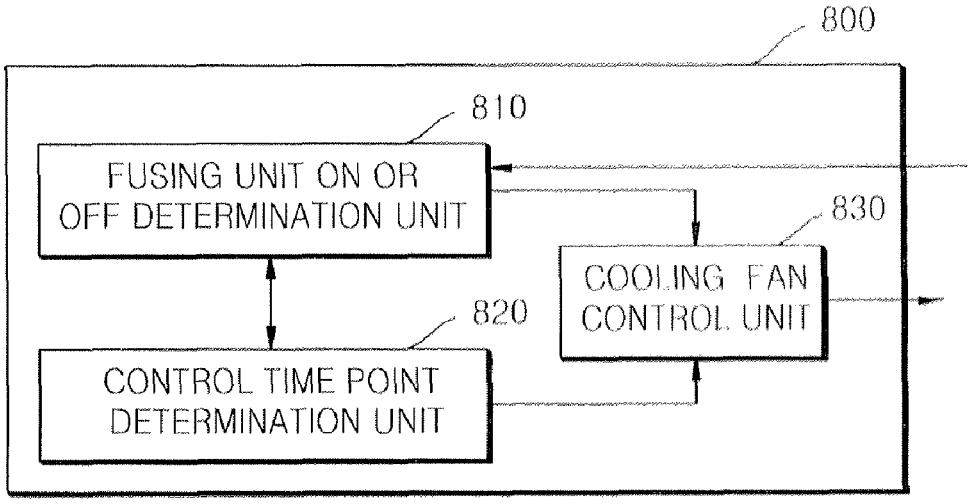
FIG. 8 is a block diagram illustrating the structure of an apparatus to control a cooling fan to cool a fusing unit of an image forming apparatus, according to another embodiment of the present general inventive concept.

FIG. 8 is a block diagram showing the structure of an apparatus 800 for controlling a cooling fan for cooling a fusing unit of an image forming apparatus, according to another embodiment of the present general inventive concept. Referring to FIG. 8, the apparatus 800 includes a fusing unit on or off determination unit 810, a control time point determination unit 820, and a cooling fan control unit 830.

The fusing unit on or off determination unit 810 determines whether the fusing unit is turned on or off according to the state of an image forming apparatus. The state of the image forming apparatus may be one of a power-on state, a warm-up state, a stand-by state, a printing state, a power-save state, and a power-off state.

The control time point determination unit 820 determines whether the cooling fan on/off condition is satisfied after the fusing unit is turned on or off. The cooling fan on/off condition is at least one of the conditions that, after the fusing unit is turned on or off, a preset delay time passes, and the fusing unit reaches a preset temperature. Also, the condition that the fusing unit reaches the preset temperature is at least one of the conditions that the fusing unit reaches a first temperature after being turned on, and the fusing unit reaches a second temperature after being turned off.

If the cooling fan on/off condition is satisfied, the cooling fan control unit 830 turns the cooling fan on or off. The cooling fan control unit 830 gradually increases the rotation speed of the cooling fan after turning the cooling fan on or gradually decreases the rotation speed of the cooling fan so as to turn the cooling fan off.

Thus, according to the present general inventive concept, the method and apparatus may control a cooling fan to cool a fusing unit of an image forming apparatus. Whether the fusing unit is turned on or off may be determined. If the fusing unit is determined to be turned on or off, it may be determined whether the cooling fan on/off condition is satisfied. If the cooling fan on/off condition is satisfied, the cooling fan may be turned on or off. Thus, the cooling fan can be driven at a high efficiency by minimizing the driving of the cooling fan when the driving of the cooling is not needed.

The present general inventive concept can also be embodied as computer readable code on a computer readable recording medium. The computer readable recording medium may be any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over a computer network so that the computer readable code is stored and executed in a distributed fashion.

While this present general inventive concept has been particularly shown and described with reference to exemplary embodiments thereof, it will be understood by one skilled in the art that various changes in form and details may be made therein without departing from the spirit and scope of the present general inventive concept as defined by the appended claims.

What is claimed is:

1. A method of controlling a cooling fan to cool a fusing unit of an image forming apparatus, the method comprising:

determining whether the fusing unit is turned on or off;

if the fusing unit is turned on or off, determining whether a condition to turn the cooling fan on or off is satisfied; and if the cooling fan on or off condition is satisfied, turning the cooling fan on or off, wherein the cooling fan on or off condition depends upon both of a preset delay time passing after the fusing unit is turned on or off and the fusing unit reaching a preset temperature, wherein the cooling fan turns on both when a first preset delay time passes after the fusing unit is turned on and the fusing unit reaches a first preset temperature, and wherein the cooling fan turns off both when a second preset delay time passes after the fusing unit is turned off and the fusing unit reaches a second preset temperature.

2. The method of claim 1, wherein the fusing unit reaching a preset temperature is at least one of the fusing unit reaching a first temperature after the fusing unit is turned on, and the fusing unit reaching a second temperature after the fusing unit is turned off.

3. The method of claim 1, wherein the preset delay time is changeable.

4. The method of claim 1, wherein the turning of the cooling fan on or off further comprises gradually increasing a rotation speed of the cooling fan after the cooling fan is turned on or gradually decreasing the rotation speed of the cooling fan after the cooling fan is turned off.

5. The method of claim 1, further comprising indicating that the cooling fan is turned on or off after the fusing unit is turned on or off.

6. A method of controlling a cooling fan for cooling a fusing unit of an image forming apparatus, the method comprising:

determining whether the fusing unit is turned on or off according to a state of the image forming apparatus;

if the fusing unit is turned on or off, determining whether each of a first condition of a preset delay time passing and a second condition of the fusing unit reaching a preset temperature has been satisfied; and if both of the first condition and the second condition are satisfied, turning the cooling fan on or off, wherein the cooling fan turns on both when a first preset delay time passes after the fusing unit is turned on and the fusing unit reaches a first preset temperature, and wherein the cooling fan turns off both when a second preset delay time passes after the fusing unit is turned off and the fusing unit reaches a second preset temperature.

7. The method of claim 6, wherein the second condition that the fusing unit reaches a preset temperature is satisfied by at least one of the fusing unit reaching a first temperature after the fusing unit is turned on, and the fusing unit reaching a second temperature after the fusing unit is turned off.

8. The method of claim 6, wherein the state of the image forming apparatus is any one of a power-on state, a warm-up state, a stand-by state, a printing state, a power-save state, and a power-off state.

9. An apparatus to control a cooling fan to cool a fusing unit of an image forming apparatus, the apparatus comprising:

a control time point determination unit configured to determine whether a cooling fan on condition or off condition is satisfied, the on condition being satisfied when both a first delay time elapses after the fusing unit is turned on and the fusing unit reaches a preset temperature, and the off condition being satisfied when both a second delay time elapses after the fusing unit is turned off and the fusing unit reaches a second preset temperature; and a cooling fan control unit to turn the cooling fan on when the control time point determination unit determines that the on condition is satisfied and to turn the cooling fan off when the control time point determination unit determines that the off condition is satisfied.

10. The apparatus of claim 9, wherein the cooling fan control unit gradually increases a rotation speed of the cooling fan after the cooling fan is turned on or gradually decreases the rotation speed of the cooling fan after the cooling fan is turned off.

11. An apparatus to control a cooling fan to cool a fusing unit of an image forming apparatus, the apparatus comprising:

a fusing unit on or off determination unit to determine whether the fusing unit is turned on or off according to a state of the image forming apparatus;

a control time point determination unit configured to determine whether a cooling fan on condition or off condition is satisfied, the on condition being satisfied when both a first delay time elapses after the fusing unit is turned on and the fusing unit reaches a preset temperature, and the off condition being satisfied when both a second delay time elapses after the fusing unit is turned off and the fusing unit reaches a second preset temperature; and a cooling fan control unit to turn the cooling fan on when the on condition is satisfied and to turn the cooling fan off when the off condition is satisfied.

12. The apparatus of claim 11, wherein the state of the image forming apparatus is any one of a power-on state, a warm-up state, a stand-by state, a printing state, a power-save state, and a power-off state.

13. An apparatus to control an image forming apparatus, comprising:

a fusing unit;

a cooling fan; and a controller configured to turn on the cooling fan when both a first delay time elapses after the fusing unit is turned on and the fusing unit reaches a preset temperature, and to turn off the cooling fan when both a second delay time elapses after the fusing unit is turned off and the fusing unit reaches a second preset temperature.

* * * * *